299-13 SR
1/23/79 OR 4,135,762

United States Patent [19]
Biancale

[11] 4,135,762
[45] Jan. 23, 1979

[54] QUARRY OPERATION

[76] Inventor: Vito Biancale, R.R. 2, Dundas, Ontario, Canada

[21] Appl. No.: 858,918

[22] Filed: Dec. 8, 1977

[30] Foreign Application Priority Data

Jul. 5, 1977 [CA] Canada ..... 282091

[51] Int. Cl.[2] ..... E21C 47/02; E21C 47/10
[52] U.S. Cl. ..... 299/13; 299/18; 299/19
[58] Field of Search ..... 299/13, 15, 18, 19; 214/9, 10; 37/195, 3

[56] References Cited

U.S. PATENT DOCUMENTS 3,799,613 3/1974 Hendry ..... 299/19
3,917,349 11/1975 Cleary, Jr. ..... 299/19
4,017,122 4/1977 Simpson ..... 299/19

*Primary Examiner*—Ernest R. Purser
*Assistant Examiner*—William F. Pate, III
*Attorney, Agent, or Firm*—Beveridge, DeGrandi, Kline & Lunsford

[57] ABSTRACT

Method of operating a quarry area comprises the steps of advancement of excavation such that a central trench is first provided for receiving overburden from adjacent strips to both sides of such trench. When the operation in the quarry is completed, a plurality of elongated spoil ridges are left with the valleys between the ridges providing solid ground for access roads to a further quarry area subsequently opened to one end of the depleted area. The method also facilitates the handling of overburden and transportation of the excavated rock in the existing quarry.

16 Claims, 10 Drawing Figures

QUARRY OPERATION

The present invention relates to a method of operating a quarry. In particular, the present invention relates to an improvement in handling overburden such as to facilitate not only the handling itself but to also simplify transportation of the excavated rock from the quarry.

The handling of overburden in quarry operations is often effected without a predetermined plan which gives rise to considerable losses in the economy of operation. Removal of overburden is an expensive part of a quarry operation involving high capital cost of equipment and running costs which combine to result in a high overhead before the real part of retrieving the quarry material can begin.

The above applies despite the fact that it is known from prior art related to strip mining or to tar sands mining process to proceed systematically in handling the overburden.

Thus, Canadian Pat. No. 982,162 issued Jan. 20, 1976 to R. D. Hendry describes an operation of tar sands mining area wherein overburden is stripped from the tar sands deposit and deposited along the outer edge of the cut. Subsequently, the exposed tar sand is removed and deposited in a row pile along the edge of the cut. Later on, a strip of overburden is removed alongside the existing cut and cast into the first cut to form a windrow. Eventually, the depleted area comprises a plurality of rows of windrows, one beside the other.

The process, if applied in quarry operations, would certainly improve the present state of more or less randomly selected way of handling of overburden. However, the way of mining one strip after another would make it impossible to use the surface of the eventually depleted quarry area for subsequent transportation of the rock from a further quarry area which is often opened after ten years or so and which normally covers a area immediately following the first quarry area. This is due to the fact that the spoil eventually remaining on top of the depleted field remains soft for an extremely long period thus making it virtually impossible to use the surface for transportation of the rock from the second quarry area unless access roads are prepared within the depleted area. Accordingly it is often necessary to provide a completely new network of access roads to a newly opened quarry area.

Reference may also be had to U.S. Pat. No. 2,291,669 issued Aug. 4, 1942 to R. S. Weimer et al, which discloses an operation in strips generally similar to that of Canadian Pat. No. 982,162 referred to above.

It is an object of the present invention to provide a new and useful method of operating a quarry area which would considerably reduce the cost of handling of overburden and of transportation of the excavated rock from the area.

Another object of the present invention is to provide a method of operating a quarry area which is favorable from the standpoint of transportation of the rock from a subsequent, second quarry area adjacent to the first, when the first area has been depleted.

In broad terms, the present invention provides a method of operating a quarry area which area is defined by two mutually opposite sides and two mutually opposite ends. The method is particularly intended for use in quarry areas of the type wherein the average depth of a rock deposit to be excavated is at least twice the depth of the overburden layer. The method comprises the steps of removing overburden from a first strip of said area, said first strip extending from one of said ends to the other, having a predetermined width and being spaced from one side of said area by a second strip of a predetermined width; excavating rock from said first strip to thus produce a first trench generally coincident with said frist strip; clearing said second strip of overburden by disposing same into said first trench; excavating rock from said second strip to thus broaden said first trench to an overall width generally corresponding to the combined width of said first and second strip; clearing a third strip of said area of overburden by depositing same into said first trench, said third strip having a predetermined width and extending along and in coincident relationship with said first strip at the side thereof remote from said second strip; excavating rock from said third strip to further broaden said first trench; whereby a first ridge of spoil generally coincident with said first strip is formed with at least a portion of said second strip and said third strip at the sides thereof remote from said first ridge being generally clear of said spoil.

In a preferred embodiment of the invention, the above method is virtually doubled thus further comprising, in addition to the steps recited above, the steps of: removing overburden from a fourth strip of said area, said fourth strip extending from one of said ends to the other, having a predetermined width and being spaced from said first trench by a fifth strip of a predetermined width; excavating rock from said fourth strip to thus produce a second trench generally coincident with said fourth strip; clearing a sixth strip of overburden by disposing same into said second trench, said sixth strip extending along said fourth strip in a generally coincident relationship with same at the side thereof remote from said fifth strip; excavating rock from said sixth strip to thus broaden said second trench to an overall width generally corresponding to combined width of said fourth and sixth strip; clearing said fifth strip of said area of overburden by depositing same into said second trench; excavating rock from the fifth strip to further broaden said second trench and to thus make said second trench coincident with said first trench; whereby a second ridge spoil, generally coincident with said first strip, is formed with at least a portion of said fifth and said sixth strip at the sides thereof remote from said second ridge being generally clear of said spoil.

According to another feature of the present invention, the removing of overburden from said first strip and from said fourth strip is effected to both sides of the respective strips.

According to a further feature of the present invention, applicable in the most usual case of a quarry wherein the depth of overburden is one half or less of the depth of the rock to be excavated, the width of the first, second and third strips is determined by a formula $$w = bd/2r;$$

wherein w = the width of said first and/or fourth strip; b = the total width of said quarry area, d = the depth of overburden, r = the depth of rock deposit to be excavated;

the second, third, fifth and sixth strips being of generally the same width.

According to a still further feature of the present invention, the steps of excavation of rock from second and sixth is effected by sequential blasting along generally parallel lines, the lines in said second strip being obliquely disposed relative to the plan of said second strip such as to define with the side of the second strip coincident with said first strip a generally V-shaped pattern diverging in plan generally in the direction of advance of excavation in said second strip; the lines in said sixth strip being obliquely disposed relative to the plan of said sixth strip such as to define with the side of the sixth strip coincident with said fourth strip a generally V-shaped pattern diverging in plan generally in the direction of advance of excavation in said sixth strip.

The invention will now be described in a greater detail by way of examples, with reference to the accompanying drawings. In the drawings.

Figure 1:
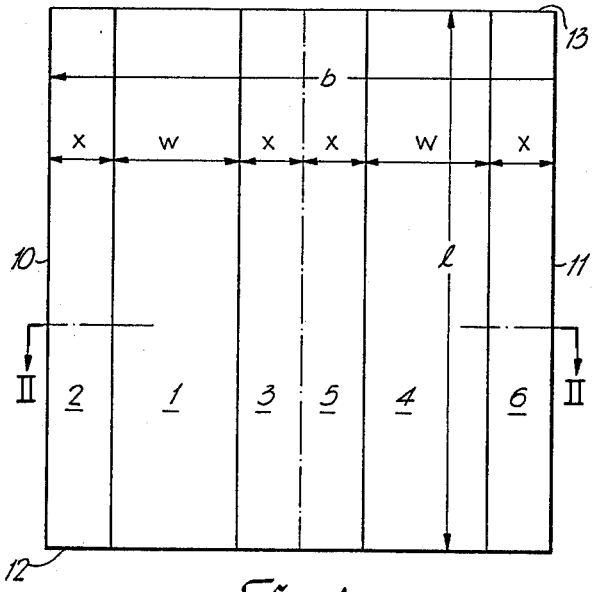
FIG. 1 is a schematic plan of a quarry area.

Turning firstly to FIG. 1, a rectangular quarry area is shown whose limits are formed by two mutually opposite sides 10, 11 and two mutually opposite ends 12, 13. The letter l designates the length of the area which, in this example, is approximately 4,000 feet. Reference letter b indicates the width of the area which is approximately 3,000 feet.

The area is shown as being divided into six strips designated with reference numerals 1–6, referring to the first, second, third, etc. strip, respectively.

Figure 2:
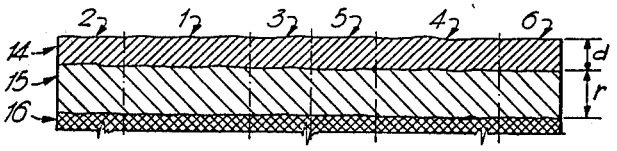
FIG. 2 is a schematic cross-section II—II of the area as shown in FIG. 1.
Figure 3:
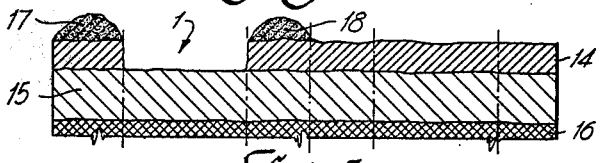
FIGS. 3–8 are schematic cross-sectional views similar to that of FIG. 2, indicating the sequence of operation according to the present invention.

Turning now to the representation of FIG. 2, it will be observed that an overburden layer 14 having depth d of about 20 ft. is deposited over a rock layer 15 whose depth r equals approximately 40 feet. The rock 15 is positioned on top of an underlayer 16 which may be the same as or different from the composition of rock 15. It is to be understood that the depth r of the rock 15 indicates the depth of the rock which is to be excavated during the operation of the quarry. Those skilled in the art will readily conceive that the underlayer 16 is normally considerably harder than the overburden layer 14.

Representations of FIGS. 1 and 2 also indicate that the width of strip 1 is w, as is the case of strip 4, while the remaining strips 2, 3, 5 and 6 are each of a width designated with x. FIG. 1 indicates by a broken line separating strips 3 and 5, that these two strips may also be considered to be a double strip having the width of 2x.

Assuming now that the quarry area which is to be operated in accordance with the present invention is of the measurements as given above and also assuming that the quarry area of FIG. 1 is intended to be followed by a second, similar quarry area whose one end would be generally coincident with the end 13 of the present area, the procedure to be followed for this particular example is as follows.

With the depths of overburden 14 and rock 15 having been determined in a known way, the first step is to determine the optimum width w. This is achieved from the formula $$w = bd/2r$$

wherein the meaning of the reference letters is as given above.

In other words, given the measurements as mentioned above, $$w = (3000 \times 20/80)$$

Thus, the optimum measurement of w is 750 ft.

In the embodiment shown in the drawings, there will eventually be two strips 1,4 each having the width of 750 ft. Accordingly, assuming that strips 2,3 5 and 6 are each to be of the same width, the width x of each of the strips will be 375 ft.

It can be readily appreciated from the above that the ratio between figure w and x will be different if the ratio between d and r is different from the above figures. For instance, if the depth d of overburden 14 is 10 ft. while the depth r of the rock layer 15 is 30 ft., and assuming that the overall width of the quarry is as shown, then $w = 500$ and $x = 500$.

The above way of establishing the values of w and x is a preferable even though not the only way of effecting the present invention.

Figure 4:
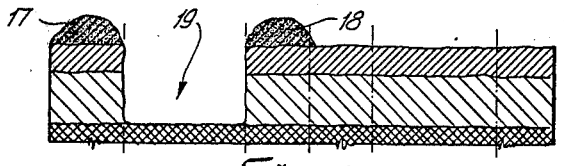
Figure 5:
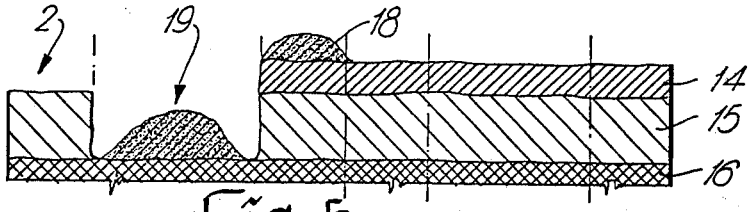

Assuming now that the values w and x have been determined as above, the first step is that of removing overburden 14 from top of the first strip 1. This is preferably done by bulldozing the overburden to both sides of strip 1 to produce spoil piles 17, 18 to both sides of strip 1. Subsequently (FIG. 4) the rock 15 is excavated, e.g. by blasting from the area of strip 1. In the shown example, one proceeds from end 12 towards end 13 as marked in FIG. 1, thus forming a first trench 19 (FIG. 4). Subsequently, the overburden from strip 2, together with the spoil pile 17, is cleared by disposing same into trench 19 (FIG. 5), thus clearing rock 15 of strip 2 for excavation by blasting.

Figure 9:
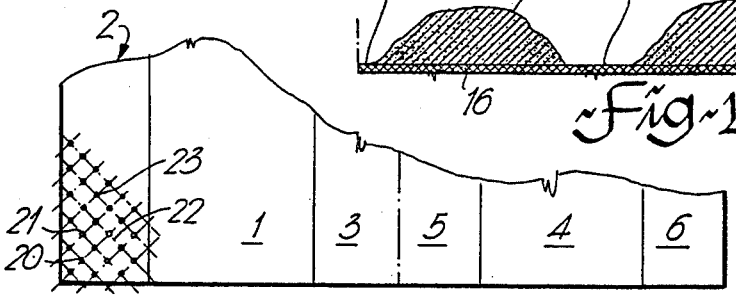
FIG. 9 is a partial schematic plan of the area with an indication of the blasting pattern in one of the strips thereof.

In the preferred embodiment of the present invention, the blasting of rock 15 from the second strip 2 is effected in accordance with a pattern shown in FIG. 9, to minimize problems that might be encountered with the sliding of the adjacent spoil in strip 1. FIG. 9 shows a plurality of rows 20–23, the rows indicating the way of sequential blasting. The first portion to be blasted is that downwards of line 20 was viewed in FIG. 9. Next line is line 21 etc. The line 20–23 are generally parallel with each other and are disposed at approximately 45° relative to the line dividing the strips 1 and 2, as viewed in plan view of FIG. 1. In general terms, the lines 20–23 are each disposed such as to define with the side of strip 2 coincident with strip 1 a generally V-shaped pattern which diverges, in plan view, generally in the direction of advance of excavation which, in this case, is the direction from end 12 towards end 13, as mentioned above.

Figure 6:
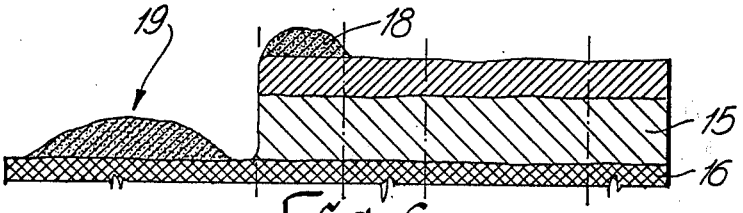

When the blasting of strip 2 reaches end 13 of the quarry area, the overall situation is as shown in FIG. 6. The trench 19 now has the width of x + w, as can be readily appreciated from FIG. 6.

Figure 7:
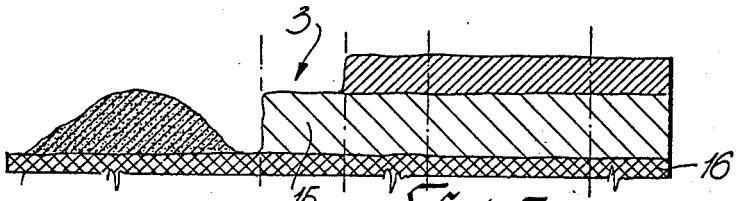
Figure 8:
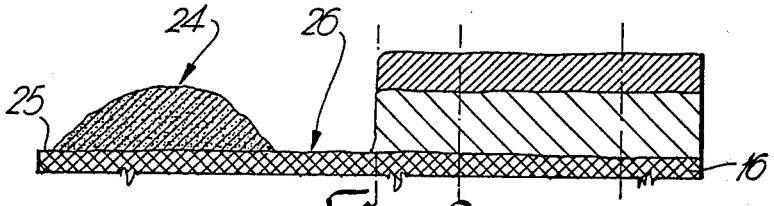

The following steps (FIG. 7) consists of clearing the third strip 3 of overburden inclusive the spoil pile 18. This results in a general configuration as shown in FIG. 7, wherein the rock 15 of strip 3 is shown in an exposed state. When the rock 15 of strip 3 has been excavated, the cross-sectional configuration corresponding to FIG. 8 is obtained. The spoil now forms a first ridge 24, the trench 19 now has the width of 2x + w (i.e. combined width of strips 1, 2 and 3). A portion 25 of strip 2 (FIG. 8) and a portion 26 of strip 3 (which are the portions of strips 2 and 3 remote from ridge 24) are virtually clear of spoil and are thus ready as truck access routes for future use in transporting rock from a subsequent quarry that would correspond to the plan of FIG. 1 that would be disposed as an extension of end 13 of the quarry.

In a preferred embodiment, the above sequence is followed with respect to the right hand side of the quarry area as shown in FIG. 1. In other words, one would continue with clearing strip 4 in a way similar to that of strip 1, followed by operating strip 6 and eventually followed by the clearing and excavating of strip 5.

With reference to FIG. 8, it will be appreciated that the above subsequent operation would render the portion 26 of strip 3 (which would now include a part of the bottom of trench portion at strip 5) even broader and thus more suitable for the subsequent trucking route as referred to above.

Figure 10:
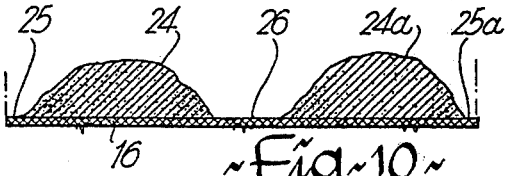
FIG. 10 is a cross-sectional view similar to that of FIG. 2 but showing the quarry area after a complete depletion of the rock deposit.

This situation is generally outlined in FIG. 10 showing two ridges 24, 24*a*, together with the portion 26.

Those skilled in the art will readily conceive further embodiments of the present invention within the same basic concept. For instance, the width w may be determined in a manner different from the way disclosed such as to produce a plurality of spoil ridges 24, 24*a* across the quarry, instead of merely two ridges as shown. Another possibility that readily occurs would be that of reversing the sequence of excavating strips 2 and 3 such that, following the excavation of strip 1, strip 3 would be excavated prior to the excavation of strip 2; such sequence would, of course, result in much broader boundary portion 25 (FIG. 8) with the intermediate portion 26 between two adjacent spoil ridges being slightly narrower than as shown in FIG. 10.

These and many other modifications of the method of the present invention, however, do not depart from the scope of the present invention as defined in the accompanying claims.

The embodiments of the invention in which an exclusive property or privilege is claimed are defined as follows:

1. Method of operating a quarry area defined by two mutually opposite sides and two mutually opposite ends, said method comprising the steps of:

(a) removing overburden from a first strip of said area, said first strip extending from one of said ends to the other, having a predetermined width and being spaced from one side of said area by a second strip of a predetermined width;

(b) excavating rock from said first strip to thus produce a first trench generally coincident with said first strip;

(c) clearing said second strip of overburden by disposing same into said first trench;

(d) excavating rock from said second strip to thus broaden said first trench to an overall width generally corresponding to the combined width of said first and second strip;

(e) clearing a third strip of said area of overburden by depositing same into said first trench, said third strip having a predetermined width and extending along and in coincident relationship with said first strip at the side thereof remote from said second strip;

(f) excavating rock from said third strip to further broaden said first trench; whereby a first ridge of spoil, generally coincident with said first strip is formed with at least a portion of said second strip and of said third strip at the sides thereof remote from said first ridge being generally clear of said spoil.

2. Method as claimed in claim 1, further comprising the steps of:

(a) removing overburden from a fourth strip of said area, said fourth strip extending from one of said ends to the other, having a predetermined width and being spaced from said first trench by a fifth strip of a predetermined width;

(b) excavating rock from said fourth strip to thus produce a second trench generally coincident with said fourth strip;

(c) clearing a sixth strip of overburden by disposing same into said second trench, said sixth strip extending along said fourth strip in a generally coincident relationship with same at the side thereof remote from said fifth strip;

(d) excavating rock from said sixth strip to thus broaden said second trench to an overall width generally corresponding to the combined width of said fourth and sixth strip;

(e) clearing said fifth strip of said area of overburden by depositing same into said second trench;

(f) excavating rock from said fifth strip to further broaden said second trench and to thus make said second trench coincident with said first trench; whereby a second ridge of spoil, generally coincident with said first strip is formed with at least a portion of said fifth strip and said sixth strip at the side thereof remote from said second ridge being generally clear of said spoil.

3. Method of operating a quarry area defined by two mutually opposite sides and two mutually opposite ends, said quarry area being of the type wherein the average depth of a rock deposit to be excavated is at least twice the depth of the overburden layer, said method comprising the steps of:

(a) removing overburden from a first strip of said area, said first strip extending from one of said ends to the other, having a predetermined width and being spaced from one side of said area by a second strip of a predetermined width;

(b) excavating rock from said first strip to thus produce a first trench generally coincident with said first strip;

(c) clearing said second strip of overburden by disposing same into said first trench;

(d) excavating rock from said second strip to thus broaden said first trench to an overall width generally corresponding to the combined width of said first and second strip;

(e) clearing a third strip of said area of overburden by depositing same into said first trench, said third strip having a predetermined width and extending along and in coincident relationship with said first strip at the side thereof remote from said second strip;

(f) excavating rock from said third strip to further broaden said first trench; whereby a first ridge of spoil, generally coincident with said first strip is formed with at least a portion of said second strip and of said third strip at the sides thereof remote from said first ridge being generally clear of said spoil.

4. Method as recited in claim 3, further comprising the steps of:

(a) removing overburden from a fourth strip of said area, said fourth strip extending from one of said ends to the other, having a predetermined width and being spaced from said first trench by a fifth strip of a predetermined width;

(b) excavating rock from said fourth strip to thus produce a second trench generally coincident with said fourth strip;

(c) clearing a sixth strip of overburden by disposing same into said second trench, said sixth strip extending along said fourth strip in a generally coincident relationship with same at the side thereof remote from said fifth strip;

(d) excavating rock from said sixth strip to thus broaden said second trench to an overall width generally corresponding to the combined width of said fourth and sixth strip;

(e) clearing said fifth strip of said area of overburden by depositing same into said second trench;

(f) excavating rock from said fifth strip to further broaden said second trench and to thus make said second trench coincident with said first trench; whereby a second ridge of spoil, generally coincident with said fourth strip is formed with at least a portion of said fifth strip and said sixth strip at the side thereof remote from said second ridge is generally clear of said spoil.

5. Method as recited in claim 1, wherein the removing of overburden from said first strip is effected to both sides of said first strip.

6. Method as recited in claim 2, wherein the removing of overburden from said first and said fourth strips is effected to both sides of the respective strip.

7. Method as recited in claim 3, in which the width of said first strip is generally equal to the width of said fourth strip, the width of said first strip being determined by a formula.

$$w = bd/2r;$$

wherein w = the width of said first and/or the fourth strip;

b = total width of said quarry area;

d = depth of overburden;

r = depth of rock deposit to be excavated;

the second, third, fifth and sixth strips being of a generally uniform width, the sum of the combined width of said second, third, fifth and sixth strips being equal to $$b - 2w.$$

8. A method as defined in claim 1, wherein the step of excavation of rock from said second strip is effected by sequential blasting along generally parallel lines, said lines being obliquely disposed relative to the plan of said second strip such as to define with the side of said second strip coincident with said first strip a generally V-shaped pattern diverging in plan generally in the direction of advance of excavation in said second strip.

9. A method as recited in claim 2, wherein the step of excavation of rock from said second and sixth strip is effected by sequential blasting along generally parallel lines, the lines in said second strip being obliquely disposed relative to the plan of said second strip such as to define with the side of the second strip coincident with said first strip a generally V-shaped pattern diverging in plan generally in the direction of advance of excavation in said second strip; the lines in said sixth strip being obliquely disposed relative to the plan of said sixth strip such as to define with the side of the sixth strip coincident with said fourth strip a generally V-shaped pattern diverging in plan generally in the direction of advance of excavation in said sixth strip.

10. In a method of operating a quarry area defined by mutually opposite sides and two mutually opposite ends, said method eventually including the steps of (a) excavating rock from a first strip to thus produce a first trench generally coincident with said first strip;

(b) clearing a second strip of overburden by disposing same into said first trench;

(c) excavating rock from a second strip of a predetermined width to thus broaden said first trench to an overall width generally corresponding to the combined width of said first and second strip;

(d) clearing a third strip of said area of overburden by depositing same into said first trench, said third strip having a predetermined width and extending along and in coincident relationship with said first strip at the side thereof remote from said second strip;

(e) excavating rock from said third strip to further broaden said first trench;

the step of removing overburden from the first strip of said area, said first strip extending from one of said ends to the other, having a predetermined width and being spaced from one side of said area by said second strip;

whereby, upon completion of said method, a first ridge of spoil, generally coincident with said first strip is formed with at least a portion of said second strip and of said third strip at the sides thereof remote from said first ridge being generally clear of said spoil.

11. The method step of claim 10 in combination with the step of excavating rock from said first strip to thus produce said first trench generally coincident with said first strip.

12. The method step of claim 10 in combination with the steps of (a) excavating rock from said first strip to thus produce said first trench generally coincident with said first strip; and (b) clearing said second strip of overburden by disposing same into said first trench.

13. In a method of operating a quarry area defined by two mutually opposite sides and two mutually opposite ends, said quarry area being of the type wherein the average depth of a rock deposit to be excavated is at least twice the depth of the overburden layer, said method eventually including the steps of (a) excavating rock from a first strip to thus produce a first trench generally coincident with said first strip;

(b) clearing a second strip, having a predetermined width, of overburden by disposing same into said first trench;

(c) excavating rock from said second strip to thus broaden said first trench to an overall width generally corresponding to the combined width of said first and second strip;

(d) clearing a third strip of said area of overburden by depositing same into said first trench, said third strip having a predetermined width and extending along and in coincident relationship with said first strip at the side thereof remote from said second strip;

(e) excavating rock from said third strip to further broaden said first trench;

the step of removing overburden from said first strip of said area, said first strip extending from one of said ends to the other, having a predetermined width and being spaced from one side of said area by said second strip;

whereby, on completion of said method, a first ridge of spoil, generally coincident with said first strip is formed with at least a portion of said second strip and of said third strip at the sides thereof remote from said first ridge is generally clear of said spoil.

14. The method step of claim 12 in combination with the step of excavating rock from said first strip to thus produce a first trench generally coincident with said first strip.

15. The method step of claim 12 in combination with the steps of (a) excavating rock from said first strip to thus produce said first trench generally coincident with said first strip;

(b) clearing said second strip of overburden by disposing same into said first trench.

16. The method steps of claim 12, wherein the width of said first strip is determined by a formula:

$$w = bd/2r$$

wherein w = the width of said first strip b = total width of the quarry area d = depth of overburden r = depth of rock deposit to be excavated.

* * * * *